United States Patent [19]

Del Barba

[11] 4,287,726

[45] Sep. 8, 1981

[54] SINGLE-CYLINDER CIRCULAR HOSIERY KNITTING MACHINE WITH DEVICE FOR MAKING RIBBED KNITWEAR FABRICS

[75] Inventor: Bruno Del Barba, Brescia, Italy

[73] Assignee: IRMAC S.p.A., Brescia, Italy

[21] Appl. No.: 26,348

[22] Filed: Apr. 2, 1979

[30] Foreign Application Priority Data

Apr. 7, 1978 [IT] Italy ..... 22089 A/78

[51] Int. Cl.[3] ..... D04B 9/22

[52] U.S. Cl. ..... 66/24

[58] Field of Search ..... 66/13, 15, 19, 24, 29, 66/199

[56] References Cited

U.S. PATENT DOCUMENTS

| | | | |
|---|---|---|---|
| 395,927 | 1/1889 | Scott et al. | 66/19 |
| 407,616 | 7/1889 | Scott | 66/19 |
| 597,488 | 1/1898 | Rowlett | 66/24 X |
| 901,839 | 10/1908 | Scott | 66/15 X |
| 2,157,300 | 5/1939 | Neuhauss | 66/24 |
| 2,622,421 | 12/1952 | Minton | 66/24 |
| 2,873,592 | 2/1959 | Larkin | 66/15 |
| 3,034,325 | 5/1962 | Minton | 66/24 X |

FOREIGN PATENT DOCUMENTS

| | | | |
|---|---|---|---|
| 107063 | 1/1900 | Fed. Rep. of Germany | 66/24 |
| 815931 | 4/1937 | France | 66/13 |
| 20615 | of 1893 | United Kingdom | 66/24 |
| 10735 | of 1911 | United Kingdom | 66/199 |

*Primary Examiner*—Wm. Carter Reynolds
*Attorney, Agent, or Firm*—Oblon, Fisher, Spivak, McClelland & Maier

[57] ABSTRACT

In a single-cylinder, hosiery knitting circular machine of the kind having a device for making knitwear articles with a ribbed pattern, the improvement is disclosed wherein each couple of needles, as formed by a horizontal needle and a vertical needle, or cylinder needle proper, lies on the same radial plane with respect to the axis of the cylinder. Each horizontal needle has its shank bent through 90 degrees and is fastened to an L-shaped selector member which is guided for radial movement. A special cambox is provided for the selector members and the horizontal needles so as controllably to bring the selector members and the attendant horizontal needles out of the way of the vertical paths over which the vertical cylinder needles run. By so doing, the loop shift from the horizontal needles to the corresponding vertical cylinder needles takes place smoothly and a regular ribbed pattern is obtained for the finished knitwear article.

3 Claims, 4 Drawing Figures

SINGLE-CYLINDER CIRCULAR HOSIERY KNITTING MACHINE WITH DEVICE FOR MAKING RIBBED KNITWEAR FABRICS

This invention relates to a single-cylinder hosiery knitting machine equipped with a device for the manufacture of articles having a ribbed pattern, such as socks.

More particularly, the invention is concerned with the problem of the stitch shift.

It is known that, for the manufacture of articles having a ribbed pattern by employing single-cylinder circular hosiery knitting machines, these latter must be equipped with two sets of needles, viz,: vertical needles (or cylinder needles), and horizontal needles (or plate or disc needles). The cylinder needles form rows of plains, whereas the plate form rows of purls, For the stitch shift to be effected, it is required that the loop be shifted from the horizontal (or plate-) needle to the vertical or cylinder-needle, and vice versa. In the former case, the plate needles which form purls must, at the programmed instant of time, cast the loops by which they are loaded onto the corresponding cylinder needles, be withdrawn centripetally and remain out of the field. The critical moment of this shifting step is just the moment at which the loop is shifted from the horizontal to the vertical needle. Should this shift be incorrectly carried out for one reason or another, unravelling is experienced and the result is scraps and attendant loss of yarn and of produced articles.

To carry out the shift of a loop from a horizontal needle to its corresponding vertical one, it is necessary that the two needles cross one another and that the vertical needle enters the loop held taut on the horizontal needle. A number of special expedients have been suggested in order that the crossing of the horizontal needles with their attendant vertical needles might be encouraged. More particularly, the horizontal needles and their corresponding vertical needles have been arranged with a slight stagger of the ones relative to the others, and the horizontal needles have been equipped with a lateral spline formed through their shanks in order to permit the entrance of the corresponding vertical needles. These expedients, however, in addition to being incapable of reliably solving the problem of the correct shift and conveyance of the loop from the horizontal needle to the vertical one, originate also a number of shortcomings, among which is an unbalance of the inter-wale space on account of the lack of centering between the inner and the outer rib. In addition, for the horizontal needles to pass the loops onto their attendant vertical needles when the former needles are withdrawn radially inwards, considerable displacements become necessary and bending stresses are originated which are frequently conducive to breaks.

An object of the present invention is to redress the troubles concisely recalled above by providing a single-cylinder circular hosiery knitting machine with a device for the manufacture of ribbed knitwear, in which the stitch shift may take place with a maximum reliability while carrying out in a fullly satisfactory manner the formation of the rib so as to obtain an improved article having a well balanced inter-wale space.

This object is achieved, according to the invention, by a circular hosiery knitting machine having two needle fields, said machine comprising a vertical axis cylinder with vertical needles axially displaceable under the control of cams of a cylinder cam box and with stitch sinkers, a plate or disc coaxially overlying the cylinder with horizontal needles which can be pushed radially under the control of cams of a plate cam box, as well as means for driving said cylinder and said plate in synchronous rotation about their common axis, characterized in that each couple of needles composed by a vertical needle and its corresponding horizontal needle is arranged on the same radial plane and in that each horizontal needle has its shank bent through substantially 90° and is fastened by the bent end of the shank to the bottom end of an L-shaped selector member guided by its horizontal portion within a radial slot of the plate, the cams of the plate cam box being capable of acting upon butts projecting from the horizontal portion of said selector members, and at least one of said cams being capable of originating movements in centrifugal direction of the selector members through such a distance as to bring the bent shanks of the horizontal needles to a position which is radially external with regard to the vertical movement paths of the corresponding vertical needles.

By virtue of the particular configuration of the horizontal needles, and also of the fact that they are overhanging supported by relative selector members and also of the configuration of the cam which originates the displacements in the centrifugal direction of both the selector members and of the horizontal needles integral therewith, in the stage of shift of the loops from the horizontal to the vertical needles, it has become possible to render fully reliable the loop shift and, more specifically, the pushing of the vertical needles through the loops held on the horizontal needles: as a matter of fact, as a result of the radially centripetal stroke impressed to the horizontal needles in this stage of the shift, the loops are substantially widened, also with the aid of the sinkers, which latter can, to this purpose, be moved radially in centripetal sense during this stage, so as to enable the vertical needles to creep smoothly and without friction and sway through the widened loops.

Inasmuch as the vertical needles are correctly centered relative to their corresponding special horizontal needles, the unbalance of the inter-wale is done away with, and a ribbed knitwear article is obtained, in which there is a correct centering between the inner and the outer rib.

The selector members which carry the horizontal needles are equipped, each, with at least a butt, on which the fixed and the movable cams of the cambox of the plate are active: these members, however, may have more than one butt in order to make possible a selective control of them by conventional mechanisms to be properly preset consistently with the kind of ribbed pattern one desires to obtain.

Further features and advantages of the invention will become apparent in greater detail from the ensuing description of an exemplary embodiment of the circular single-cylinder machine, aided by the accompanying drawings, wherein.

Figure 1:
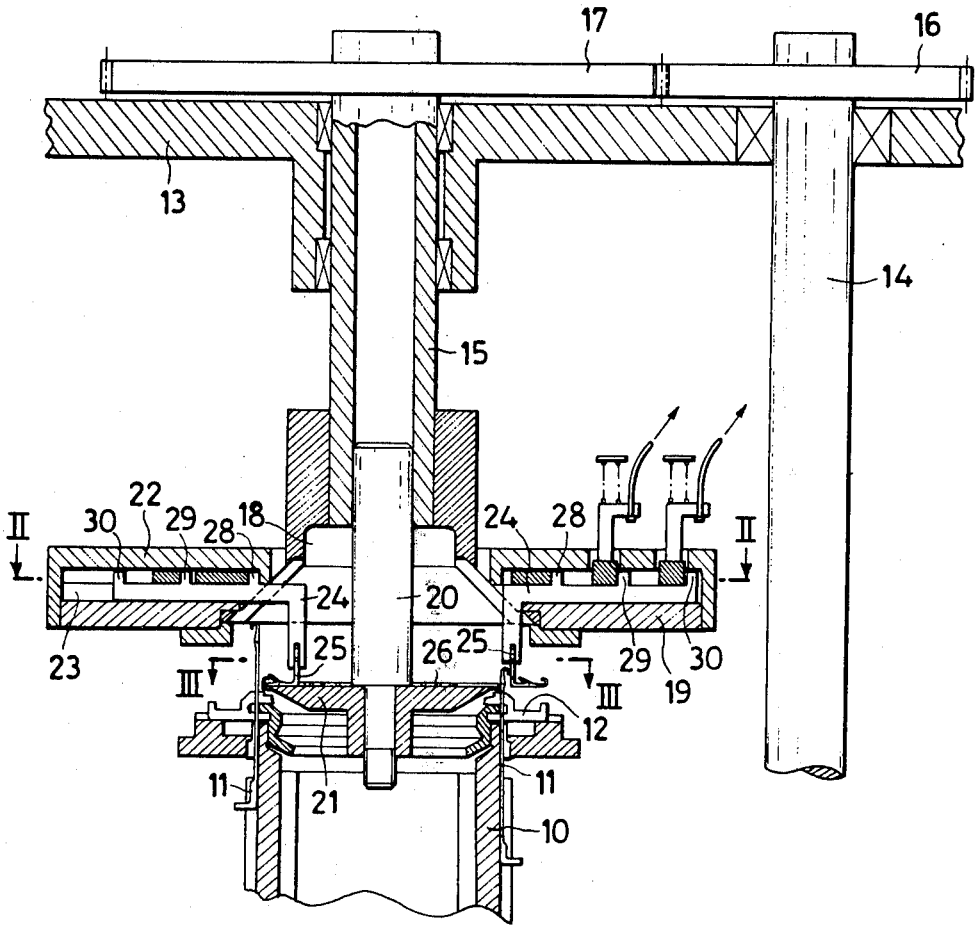
FIG. 1 is a vertical cross-sectional view of the top section of the machine equipped with the principal component parts necessary for making a ribbed knitwear.

It should be considered that the drawings show, for the single-cylinder circular machine, only those component parts which are essential for the understanding of the invention: these are shown diagrammatically only and all those component parts which are not shown in the drawings and not specifically described herein are intended as being embodied quite conventionally.

The machine substantially comprises a vertical-axis cylinder 10, which is supported conventionally in a framing and is driven with conventional means for rotation about its axis. Peripheral needle-tracks parallel to the cylinder axis receive the vertical needles, 11, the rising and sinking movements of which for the stitch formation are controlled by the cams of a cylinder cam box (not shown), in a quite conventional fashion. The usual sinkers 12 are also provided, to be controlled by cams (not shown), said sinkers cooperating with the vertical needles 11 for the formation of the stitch.

The machine has, at its top, a platform 13 which is integral with the machine frame and supports for rotation a side shaft 14 and a central shaft 15: the latter is coaxial with the axis of the cylinder 10. The two shafts 14 and 15 are mutually connected by a couple of spur gears 16–17. The shaft 4 receives the drive from the cylinder carrier of the machine and the gear ratios are so calculated that the shaft 15 is rotated at the same RPM as the cylinder 10.

The shaft 15 carries a bell-shaped member 18, which supports a plate or disc 19 coaxially with the cylinder 10. In addition, an extension 20 of the shaft 15 supports a needle-plate 21, also coaxial with the cylinder 10 and arranged slightly above the top edge of 10.

Above the plate 19 there is a fixed lid 22 carried by the machine frame and said lid carries fixed and movable cams as will be explained hereinafter.

Radial tracks formed in the plate 19 slidably receive selector members 24 in the shape of an L. More exactly, the longer horizontal section of each selector member 24 is received within a track 23 of the plate 19, whereas the shorter vertical section freely depends from the central area of the plate 19, the latter being annular in shape. To the free end of the vertical section of each selector member 24 is fastened the shank, bent substantially through 90° of a horizontal needle 25. As best seen in FIG. 1, the shank of this needle extends through a certain distance of the vertical portion of the selector member 24 and is then bent in a direction parallel to the horizontal portion of the selector member itself, so that the needle is oriented radially outwards.

The horizontal needle 25 rest on the needle-plate 21 and, during their radial motion, as will be explained hereinafter, they can enter into radial guiding tracks 26 (best shown in FIG. 3) provided in the needle-plate 21. The tracks or slots 26 have wide recesses 27 to encourage the entrance of the needle 25 thereinto.

It is to be noted that each vertical needle 11 (cylinder needle) has a corresponding horizontal needle 25 (plate needle), and that each couple of such needles is arranged on the same radial plane. Stated otherwise, the peripheral track of the cylinder 10 in which the vertical needle 11 is housed, the radial track 23 of the disc 19 in which the relative selector member 24 is received, and the radial track 26 of the needle-plate 21 in which the respective horizontal needle 25 is inserted, lie on a vertical radial plane passing through the central axis of the machine.

The selector members 24, and their horizontal sections, can be equipped, in the example shown, with three butts 28, 29 and 30 which project upwards and on which the movable and the fixed cams of the lid 22 are intended to be active. It is to be borne in mind that the most important butt is the innermost one 28, whereas the other butts 29 and 30 could be also dispensed with. As a matter of fact it is just upon the butt 28 that the fixed cams are active, which compel the selector members 24 to carry out those radial movements, either centrifugally or centripetally, which enable the horizontal needles 25 to perform the stitch formation and the loop-shift operation to the vertical needles.

Figure 2:
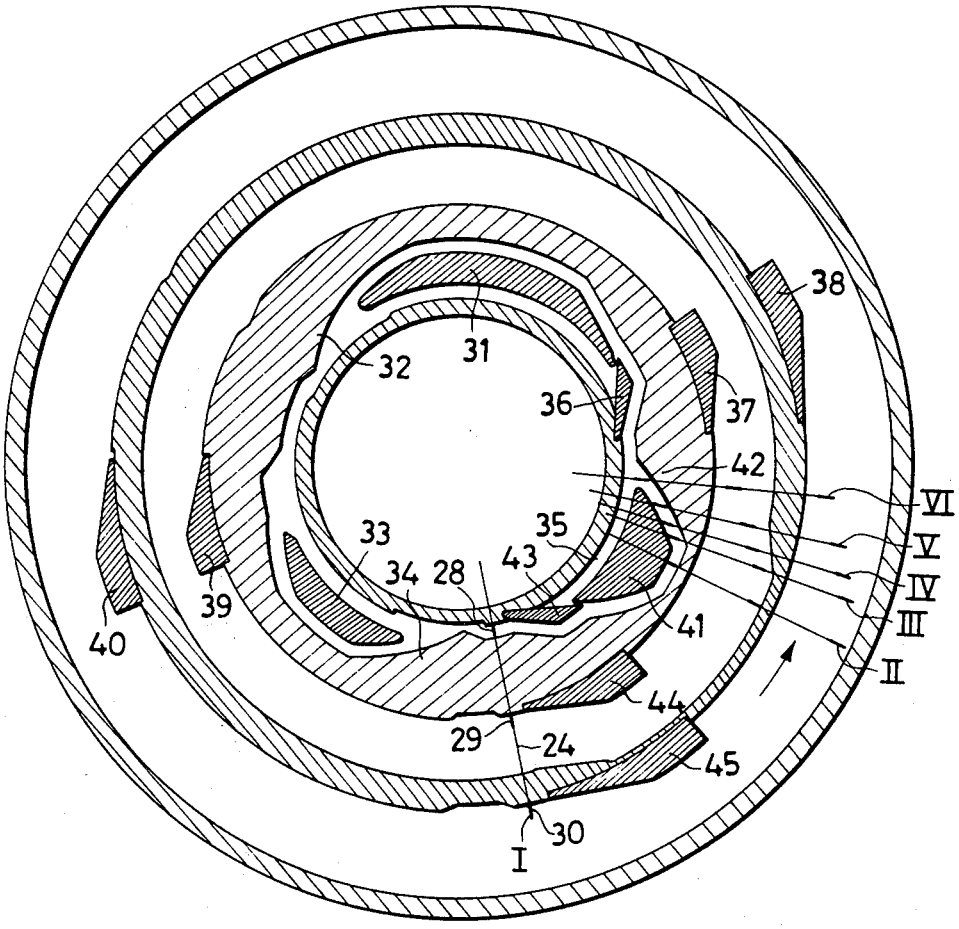
FIG. 2 shows the cam box of the plate in cross-sectional view taken along the line II—II of FIG. 1.

FIG. 2 shows the movable and the fixed cams of the cam box of the plate which act upon the butts of the selector members which carry the horizontal needles.

As can be seen in FIG. 2, the cam box comprises fixed cams 31, 33 with relative counter-cams 32, 34 the task of which is to impress to the horizontal needles 25, via the relative selector members 24, the radial movements which are required for the formation of the stitch. These cams are capable of acting upon the butts 28 of the selector members 24 to move the horizontal needles 25 radially outwards (in the centrifugal direction) to cast off the old loop beyond the needle latch and to grasp the thread, and then radially inwards (in the centripetal direction) to make up a fresh loop, in the manner which is well known in the art.

In order that the butts 28, which, in the inoperative stage are moved along the circular raceway 35 in the direction of the arrow shown in the drawing, rather than passing in front of the fixed cams 31, 33 may be caused selectively to "rise" on said cams, the movable cams 36, 37, 38 and 39, 40 are respectively provided: of these, the cam 36 can act on the butts 28, the cams 37 and 39 can act upon the butts 29 and the cams 38 and 40 can act on the butts 30 of the selector members 24. It is apparent that every one of these movable cams, when inserted, acts on the selector members 24 which are equipped with the respective butts, to move the selector members in a radially outward direction to an extent which is sufficient to have the butt 28 of the selector members rising on the profile of the relative fixed cam 31 or 33 in order to be further pushed outwards.

The fixed cams from 31 to 34, and the movable ones from 36 to 40 thus serve to have the horizontal needles 25 effecting the movements which are required for the formation of purls. It is apparent that, if a certain horizontal needle forms a loop, the corresponding vertical needle does not form any loop, inasmuch as each couple of needles, horizontal and vertical, forms on the knitwear article the same row of loops (the horizontal needle forms purls, and the vertical needle forms plains).

The cam box of the plate has two further fixed cams 41 and 42 served by movable cams 43, 44, 45. Also in this case, the fixed cams 41, 42 can act upon the butts 28 of those selector member 24 only, which have previously been pushed radially outwards by the action of one of the movable cams 43, 44 or 45 which are capable of acting upon the butts 28, 29 and 30 of said members, respectively. If none of the movable cams 43, 44, 45 is operatively positioned or on, the butts 28 of the selector members 24 pass before the fixed cam 41 in the raceway 35.

The fixed cams 41, 42, and the movable cams 43, 44, 45 are intended to cause the horizontal needles 25 to effect the radial centrifugal and centripetal movements which are required for shifting the loops to the vertical needles 11, as will be explained in more detail hereinafter with reference to FIGS. 3 and 4.

Figure 3:
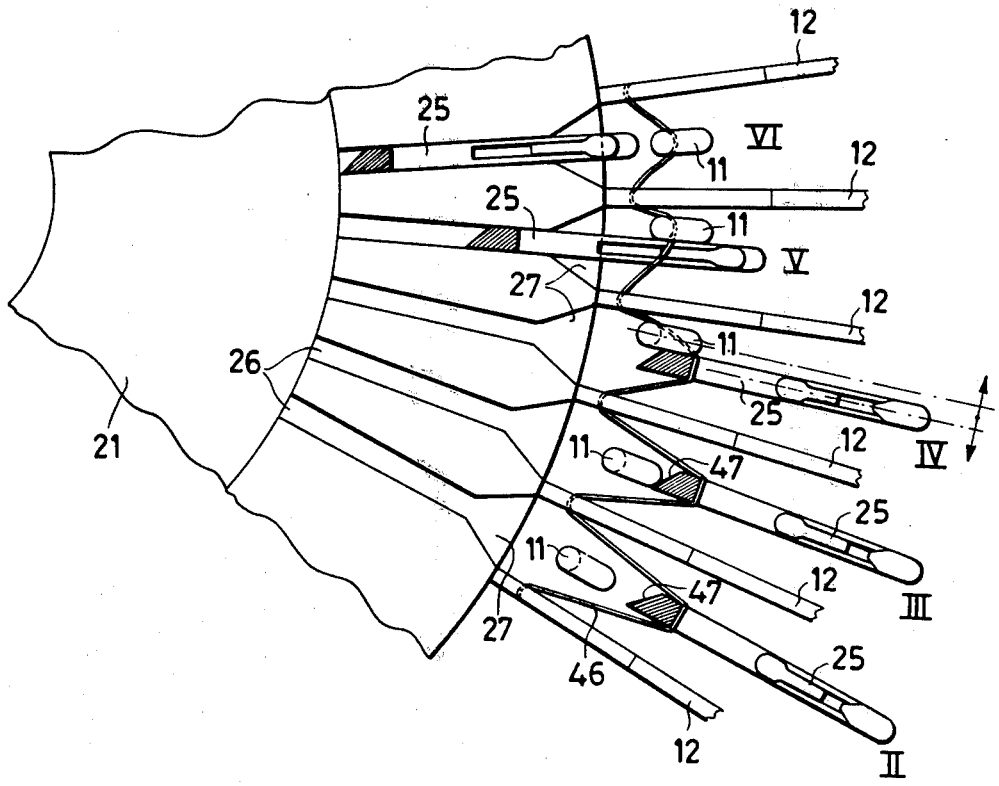
FIG. 3 is a plan view, taken in the direction of the line III—III of FIG. 1 and shows the sequential stages of the shift of a loop from a horizontal needle to the corresponding vertical one.
Figure 4:
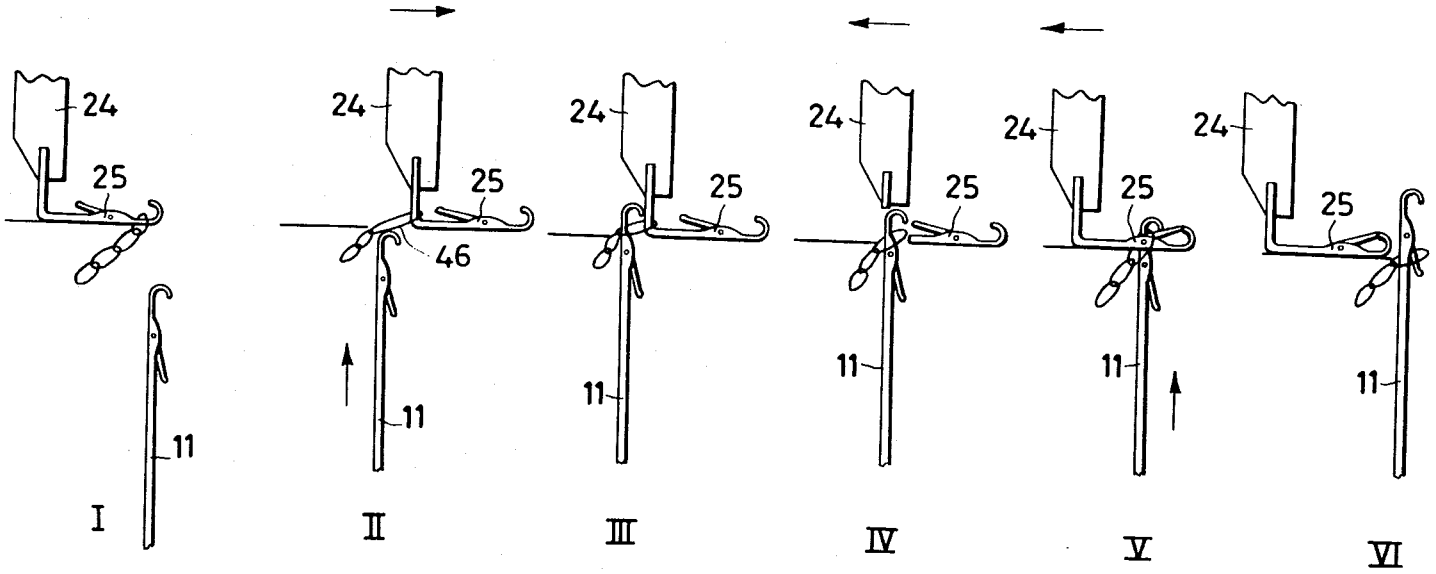
FIG. 4 shows the same stages as in FIG. 3, diagrammatically shown in sequentially arranged side elevational views.

In FIGS. 3 and 4 five positions are shown in sequence, indicated at II . . . VI, of the horizontal needles 25 and the vertical needles 11 during progress of the loop shift stage, and in FIG. 2 the corresponding positions of the relative selector members 24 are shown. In addition, in FIGS. 2 and 4 a position I, is indicated for the selector member and its respective horizontal needle, which is called an "inoperative position," after the formation of purl, that is, with the loop on the horizontal needle, while the corresponding vertical needle has no loop on its shank.

If, starting from such inoperative position, the selector member 24 of the needle concerned abuts one of the cams 43, 44 or 45 "on," the selector carrying the horizontal needle is compelled by the cam 41 to be moved radially onward until reaching the outermost position II. In this position II, the needle 25 has its shank radially external relative to the vertical path of its corresponding vertical needle 11 (see FIGS. 3 and 4) and the loop 46, held on the shank of the horizontal needle 25 is substantially widened. Such a widening of the loop 46 can be assisted by a restricted radially inward motion of the sinkers 12 which, together with the needles, retain the loop row.

The vertical needle 11 which is raised simultaneously in its trick of the cylinder 10 can thus easily slip into the widened loop 46 (position III). While the vertical needle 11 remains lifted, the horizontal needle 25 is urged by the cam 42 to run radially backwards (centripetally), position IV, and, during progress of this movement, the two homologous needles, i.e. the horizontal and the vertical ones, cross one another and there is a slight relative shift (in the direction of the arrows in FIG. 3) of the two needles which is assisted by a bevel formed on the shank of the horizontal needle 25, said bevel being referenced at 47, in FIG. 3.

During the centripetal motion of the horizontal needle 25, the latter slides back in the corresponding radial track 26 of the needle-plate 21 and such backward stroke is facilitated by the wide recess 27. The loop flips the latch of the horizontal needle 25 shut (position V), whereas the vertical needle 12 is raised farther until the loop, now cleared of the horizontal needle 25, flips the latch of the vertical needle open (position VI).

It is apparent from the foregoing that, by virtue of the special configuration of the horizontal needles and their control by the selector members and the stroke impressed during the loop shift stage, the transition of the loop from the horizontal needle to the vertical needle is successful without having the vertical needle bumping against obstacles during its creeping into the loop to be shifted or scratching the loop or misplacing it.

In addition, because of the horizontal needles being exactly centered relative to the vertical needles, the inter-wale space is correctly balanced and the rib pattern is correctly reproduced.

It should be noted, lastly, that by virtue of the special configuration of horizontal needles and their suspension by means of selector members guided within tracks formed in an annular plate which, viewed in vertical projection, is outside the machine cylinder, the problems hitherto experienced especially in machines having a high gauge (a considerable number of needles per inch) in connection with the machining and arrangement of the guiding tricks have been offset.

What is claimed as new and desired to be secured by Letters Patent of the United States is:

1. A single-cylinder circular hosiery knitting machine fitted with a device for producing ribbed knit-wear articles by a process including the step of shifting knit loops, comprising a vertical-axis cylinder including vertical needles axially displaceable under the control of cams of a cylinder cam box and also including stitch sinkers, a plate or disc coaxially overlying the cylinder and including horizontal needles which can be pushed radially under the control of cams of a plate cam box, means for driving said cylinder and said plate in synchronous rotation about their common axis, wherein each couple of needles composed by a vertical needle and its corresonding horizontal needle is arranged on the same radial plane and wherein each horizontal needle has its shank bent through substantially 90° and is fastened by the bent end of the shank to the bottom end of an L-shaped selector member guided by its horizontal portion within a radial slot of the plate, and wherein said shank includes a bevel adjacent said bend to deflect each said vertical needle from said radial plane during the centripidal movement of each said horizontal needle, the cams of the plate cam box being capable of acting upon butts projecting from the horizontal portion of said selector members, and at least one of said cams of said plate cam box being capable of originating movements of said selector members having horizontal needles fastened thereto in the centrifugal direction through such a distance as to bring the bent shanks of the horizontal needles to a position which is radially external with regard to the vertical movement paths of the corresponding vertical needles, whereby said horizontal needles do not interfere with said vertical needles except during the deflection of said vertical needles provided by said bevels during centripidal movement of said horizontal needles during shift of loops from said horizontal to said vertical needles.

2. Machine according to claim 1, wherein the horizontal needles carried by the selector members are at the level of the plane of a needle-plate, said needle-plate being rigidly connected to said plate so as to follow the rotary motion thereof and being coaxial with the cylinder, the top plane of the needle-plate being equipped with radial guide-ways adapted to receive the horizontal needles in their inward radial motion.

3. Machine according to claim 2, characterized in that said radial guideways for said needle-plate are peripherally widened to encourage the entrance of the horizontal needles thereinto.

* * * * *